US006189623B1

(12) United States Patent
Zhegrov et al.

(10) Patent No.: US 6,189,623 B1
(45) Date of Patent: Feb. 20, 2001

(54) METHOD OF EXTINGUISHING A FIRE, SYSTEM FOR ITS REALIZATION AND FIRE EXTINGUISHING GENERATOR USED, IN PARTICULAR, IN SAID SYSTEM

(75) Inventors: Evgeny Fedorovich Zhegrov; Alexandr Ivanovich Doronichev; Jury Michailovich Milechin, all of Moskovskaya obl., g. Dzerzhinsky (RU)

(73) Assignees: Federalny Tsentr Dvoinykh Tekhnology "Sojuz", Moscow (RU); AES International Pty. Ltd., Hurstville (AU)

( * ) Notice: Under 35 U.S.C. 154(b), the term of this patent shall be extended for 0 days.

(21) Appl. No.: 09/446,406

(22) PCT Filed: Jul. 1, 1998

(86) PCT No.: PCT/RU98/00206

§ 371 Date: Dec. 20, 1999

§ 102(e) Date: Dec. 20, 1999

(87) PCT Pub. No.: WO99/01180

PCT Pub. Date: Jan. 14, 1999

(30) Foreign Application Priority Data

Jul. 2, 1997 (RU) ..... 97111561

(51) Int. Cl.[7] ..... A62C 2/00

(52) U.S. Cl. ..... 169/45; 169/56; 169/60; 252/2

(58) Field of Search ..... 169/45, 56, 70, 169/26, 5, 6, 7, 60, 61; 252/2, 3, 4, 5, 6, 7

(56) References Cited

U.S. PATENT DOCUMENTS

| | | |
|---|---|---|
| 2,719,589 | 10/1955 | Mapes . |
| 5,613,562 | 3/1997 | Galbraith et al. . |

FOREIGN PATENT DOCUMENTS

| | | |
|---|---|---|
| 0 561 035 | 1/1992 | (EP) . |
| 0 637 458 | 2/1995 | (EP) . |
| 2 028 127 | 3/1980 | (GB) . |
| 94002970 | 1/1994 | (RU) . |

*Primary Examiner*—Andres Kashnikow
*Assistant Examiner*—Lisa Ann Douglas
(74) *Attorney, Agent, or Firm*—Kenyon & Kenyon

(57) ABSTRACT

The invention relates to a method of extinguishing a fire of complex category with flame burning accompanying with smoldering of products of burning. Besides, the disclosure concerns a fire extinguishing system embodying the method and a fire extinguishing generator used, in particular, in the system. The method of extinguishing a fire provides introduction of a flow of flame inhibiting aerosol into the center of burning, introduction into the center of burning or to element contacting with the center of burning of a cooling agent having endothermic properties and maintenance of the temperature in the center of burning lower than the temperature of resuming of flame chain reactions in the center of burning, and introduction into the center of burning of additional portions of cooling agent, introduction of additional portions of cooling agent is being continued until the moment, when own maximal temperature of the center of burning will become lower than the temperature of resuming of burning reactions in the products of burning, that results in liquidation of smoldering of products of burning and in extinguishing the fire as a whole.

40 Claims, 3 Drawing Sheets

METHOD OF EXTINGUISHING A FIRE, SYSTEM FOR ITS REALIZATION AND FIRE EXTINGUISHING GENERATOR USED, IN PARTICULAR, IN SAID SYSTEM

FIELD OF THE INVENTION

The invention relates to technology of extinguishing a fire, particularly, to a method of extinguishing a fire, a fire extinguishing system embodying said method and a fire extinguishing generator.

BACKGROUND ART

Widely known are methods of extinguishing a fire providing introducing into the zone of burning of fire extinguishing agents—liquid, gaseous, powders and flame inhibiting aerosols. Variety methods and means are known for introducing said agents into the center of burning.

However, as the practice of struggle with fire of complex category shows, application of these fire suppressing agents separately does not result in effective extinguishing. The reason for this is that, the majority of fires are of a complex physicochemical process, in course of which, as a rule, there is occurring burning and oxidation of materials subject to burning both in so-called gaseous phase accompanying with formation in the focus of burning of seen flame, and in so-called condensed phase, when the material subject to burning burns so to say from inside, with destruction of its internal structure, but without a seen flame of burning. Thus it is necessary to emphasize, that such fires are accompanied with long period of smoldering of products of burning both during the flame burning and during the long period after it A classical example of such burning is burning of cellulose containing materials such as wood, fabrics, cotton products and other, i.e. materials widely used in all branches of industry and transport.

A method of fire extinguishing is known from the European patent EP 0 561 035 which comprises the following stages: preliminary arrangement in the protected volume of a means for extinguishing a fire containing a first reagent consisting from potassium perchlorate or potassium nitrate or mix thereof, and a second reagent containing epoxy resin; in case of fire it is activated reaction between the first and the second reagents in result of which they interact with formation of dry powder of firm particles in suspended condition (aerosol), these particles have diameter not exceeding 1 micron; said aerosol is cooled, flame is suppressed with help of said aerosol, thus there is occurring chemical and physical suppression of chain reactions of the flame in the center of burning, which results in extinguishing of the fire. In other words, into the center of burning it is introduced a flow of flame inhibiting aerosol which concentration exceeds concentration sufficient for interruption of chain reactions of the flame, Mat results in liquidation of the flame in the center of burning.

The above described method of extinguishing a fire is rather effective for burning materials or agents which are not accumulating thermal energy in their internal structure. Such fires seldom occur in practice. The reason for this is in that, this method of fire extinguishing is based on application of a flame inhibiting aerosol which interrupts chain reactions of the flame just in the gas phase of the center of burning, but, that is necessary to emphasize, does not influence the reactions proceeding in its condensed phase. It means, that with liquidation of flame burning, smoldering of products of burning will keep on, in other words fire will proceed in most dangerous, latent form, at which the seen attributes of fire are not present, but probability of sudden repeated ignition is rather high It is necessary to emphasize that this process is accompanied by hidden accumulation of thermal energy both as a result of smoldering of products of burning and due to increase of concentration of products of burning in the center of burning, e.g., because of falling half burned constructions in the center of burning or due to distribution of smoldering deep into the initial material of burning. It results in gradual, sometimes imperceptible for human, increasing of temperature up to critical level, when flame ignition will be resumed. It is necessary to emphasize that this process is of uncontrolled spontaneous character, therefore it is very dangerous in itself.

The same European patent EP 0 561 035 discloses a plurality of generators for extinguishing a fire embodying the above described method Each of said generators comprises a hollow case, a charge of flame inhibiting aerosol, placed in the hollow of said case at one of its face walls, an initiating means for actuating the generator arranged in said charge and capable to receive starting command signals, a cooling means of the flow of flame inhibiting aerosol, placed in said case of the generator and a cavity formed between said charge and said cooling means.

In this patent there are-described several embodiments of the cooling means of the flow of flame-inhibiting aerosol. For example, on FIGS. 1, 4, 5, 6 and 7 this means is shown as a capacity with cooling liquid. At combustion of the charge-it is formed a flow of flame inhibiting aerosol that is being exhausted from the generator, due to creation of underpressure in the cavity of the case it captures and atomizes in the flow particles of the cooling liquid, as it is shown on FIG. 1 and 4, or aerosol is bubbling in the cooling liquid, as it is shown on FIG. 5, 6*a,* 7*a,* resulting in cooling of the aerosol flow.

It is necessary to accentuate, that temperature of the flow of the flame inhibiting aerosol before cooling is on the order of 1000° C.–1200° C., and it is a precondition of physicochemical interaction of the aerosol flow with the cooling liquid, that results in dissolution of aerosol particles in the cooling liquid and in evaporation of the cooling liquid, as well as in chemical transformation of the agents comprising the aerosol, e.g., potassium carbonates into hydrocarbonates. These factors reduce concentration of aerosol firm particles in the flow, that is released from the generator and leads to degradation of its fire suppressing activity. Thus, efficiency of the released flow of aerosol and the generator as a whole will be reduced. Similar processes occurring when a cooling gas or a cooling powder is used instead of cooling liquid, as it is shown on FIG. 3 and on FIG. 4.

Closest to the claimed generator is the fire extinguishing generator disclosed in the description of the Russian Federation Patent Application 94 002970, presented on FIG. 8 and containing a case; a cavity formed in the case; a first face wall of the case; a second facewall of the case; a lateral wall of the case connected by its first end face and its second end face with, correspondingly, the first face wall and the second face wall; the central partition formed in the cavity of the case and fixed on the edges on the case lateral wall; a first chamber formed from the side of the first face wall and delimited by the central partition, the first face wall and the lateral wall of the case; a second chamber formed on the side of the second face wall and delimited by the central partition, the second face wall and the lateral wall of the case; a charge of the flame inhibiting aerosol, installed in the first chamber at the first face wall and intended for producing of the flow of the flame inhibiting aerosol; a first empty cavity formed in the first chamber between the charge of the flame inhibiting aerosol and the central partition; an initiating means for actuating the generator placed in the charge of the flame inhibiting aerosol and capable to receive starting command signals; an additional partition installed in the second chamber and fixed by the edges on the lateral wall of the case; the second empty cavity formed in the second chamber and delimited by the central partition, the additional partition and the lateral wall; a third cavity formed in the second chamber and delimited by the additional partition, the second face wall and the lateral wall of the case; a charge of fire suppressing agent placed in the third cavity; a first set of channels formed in the central partition and intended for passing of the flow of the flame inhibiting aerosol from the first chamber into the second empty cavity; a second set of channels formed in the additional partition and intended for passing of the flow of the flame inhibiting aerosol from the second empty cavity into the third cavity filled by said charge of the fire suppressing agent; a nozzle formed in the second face wall of the case and intended for passing of the flow of the flame inhibiting aerosol and the fire suppressing agent from the third cavity into said center of burning.

In comparison with the generator described in the European Patent EP 0 561 035, the generator disclosed in the Russian Patent Application 94 002970 has that feature, that a fire suppressing powder is used as the fire suppressing component, concentration of which in the flow outflowing from the generator with the lapse of time decreases and concentration of the flame inhibiting aerosol proportionally increases, in result of this it is formed environment of the fire suppressing powder atomized in the flame inhibiting aerosol. Environment of the fire suppressing powder atomized in the flame inhibiting aerosol allows to extinguish smoldering products of burning hat in comparison with the pure aerosol method of fire extinguishing, disclosed in the European Patent EP 0 561 035, expands sphere of application of such generators.

However, the practice of using of such generators and fire suppressing environment showed, that it is quite effective only for extinguishing of smaller centers of burning where there are present both gaseous and condensed phases of burning of the burning products. It is specially effective in case of absence of the gaseous phase of burning accompanied by intensive convective flows of gaseous products of burning.

In case of large fires, fires of complex category, when there are present intensive convective flows, it occurs intensive carrying away of the powdery fire suppressing agent from the surface of burning which has not reached it. It is specially characteristically for the first stage of feeding into the center of burning of the fire suppressing powder, when its concentration is maximal. Besides, a drawback of the described generator is interaction of the flame inhibiting flow of aerosol having temperature 1000° C.–1200° C. with the fire suppressing powder. In fact it occurs partial decomposition and sintering of the fire suppressing powder, that results in loss of its efficiency, in decreasing of effective amount of the fire suppressing powder reached the center of burning, in other words, it occurs its partial deactivation. Simultaneously it also occurs loss of the aerosol, as the thermal decomposition of the fire suppressing powder is accompanied by formation of a liquid-viscous consistence in it capable to catch firm particles of aerosol from the flow. The initial precondition of all these drawbacks is high temperature of the flame inhibiting flow of aerosol which is developed in result of ignition and subsequent burning of the charge generating the flame inhibiting aerosol.

SUMMARY OF THE INVENTION

The object of the present invention is creation of a method of extinguishing a fire, application of which would allow effectively and in short time to extinguish fires of a complex category characterized by presence in the center of the fire of a gaseous phase, accompanied by formation of intensive convective flows of gas and a condensed phase of burning accompanied by presence of smoldering processes in products of burning.

Another object of the present invention is creations of a fire extinguishing system embodying the above mentioned method Still another object of the present invention is creation of a fire extinguishing generator, in construction of which it is provided a cooling means of the flame inhibiting aerosol which is made from a material, that together with the flow of the flame inhibiting aerosol educes additional gas flows of flame inhibiting agents, adding to the flow of aerosol additional and specific flame inhibiting properties.

This and other objects are achieved by means of the method of extinguishing a fire providing, substantially, the following consecutive stages: (a) introducing into the center of barring the flow of a flame inhibiting aerosol concentration of which exceeds the concentration sufficient for interruption of chain reactions of the flame, that results in liquidation of the flame with continuation of smoldering of products of burning in the center of burning; (b) introducing into the center of burning and/or to an element contacting with the center of burning of a cooling agent having endothermic properties, that results in decreasing of the temperature in the center of burning to the level lower than the temperature of resuming of flame chain reactions in the center of burning; (c) maintenance in the center of burning the temperature level lower than the temperature of resuming of flame chain reactions in the center of burning by means of introducing into the center of burning of additional portions of cooling agent, introduction of additional portions of cooling agent is being continued until the moment, when own maximal temperature of the center of burning will become lower than the temperature of resuming of burning reactions in products of burning, that results in liquidation of smoldering of products of burning and in extinguishing the fire as a whole.

In result of introducing into the center of burning of the flame inhibiting aerosol, flame burning of gaseous products educing at destruction of the burning material is ceased. As result of this the thermal flow directed from the zone of flame gas reactions to the surface of the burning focus is liquidated. It results first of all in decreasing of the temperature in the center of burning and, as consequence of it, to sharp decreasing in intensity of formation of the gaseous products of reaction. It means, that the intensity of the convective flows escaping from the burning surface of the center of burning essentially decreases, and access of the cooling agent to this surface is facilitated. In other words, it is prevented carrying away of the cooling agent by the convective flows of gaseous products of burning, that creates preconditions for maintenance of its direct contact with the surface of burning and its more complete use. After the flame will be put out by the flame inhibiting aerosol the center of burning remains to be of high temperature sufficient for spontaneous uncontrollable ignition of gaseous products of burning. Thus it is necessary to remember, that in spite of the aerosol has interrupted the chain reactions of burning of the gaseous products, it has not rendered essential influence on the reactions proceeding in the condensed phase in the center of burning. In other words, the fire in the condensed phase of the center of burning proceeds in form of smoldering. The cooling agent is introduced in order to reduce the temperature in the center of burning to the level lower than the temperature of spontaneous ignition of the gaseous products of burning. With decreasing of the temperature, probability of resumed spontaneous ignition of the gaseous products of burning decreases. However the temperature in the focus of burning is sufficiently high for maintenance of the burning reactions in the condensed phase in form of smoldering. For guaranteed extinguishing the fire, additional portions of the cooling agent are introduced into the center of burning. Thus introduction of the additional portions of the cooling agent is performed to the moment, when own maximal temperature of the center of burning will become lower than the temperature of renewal of burning reactions in the products of burning, that results in liquidation of smoldering of the products of burning and in extinguishing the fire as a whole.

It would be expedient to perform introduction of the cooling agent into the center of burning after liquidation of the flame in the center of burning and before the concentration of the flame inhibiting aerosol will become equal to the level which is lower than the level of concentration of renewal of the flame chain reactions in the center of fire. Otherwise decreasing of the aerosol concentration below the specified concentration level can result in spontaneous resumed ignition of the gaseous products and, as a consequence of it, introduction of the cooling agent would be characterized by the above mentioned drawbacks.

If extinguishing a fire is carried out in open space, introduction of the flow of cooled flame inhibiting aerosol into the center of burning is performed with a speed exceeding the speed of the convective gas flows, exhausted from the products of burning formed in the center of burning. It is caused by that, penetration of the flame inhibiting aerosol into the zone of gaseous-flame reactions and creation there of the flame inhibiting concentration sufficient for interruption of the chain reactions of burning, is complicated by the convective flows deviating the flow of the flame inhibiting aerosol Introduction of the aerosol flow with a speed exceeding the speed of convective flows from the products of burning formed in the center of burning, allows to overcome resistance of the convective flows and thus to solve this problem.

It is not less expedient, that the contour of cross section of the flow of cooled flame inhibiting aerosol in the plane of the center of burning would cover the contour of the center of burning in said plane. It allows to-create on all section of the convective flow, coming from the center of burning, concentration of the flame inhibiting aerosol sufficient for interruption of the chain reactions of the flame in the center of burning.

It would be reasonable to use a fire suppressing liquid, for example water, as the cooling agent. Water is the most available and cheap cooling agent. It has rather nigh heat capacity and high degree of heat absorption at phase transitions, i.e. at melting or evaporation.

It is also possible to use as the fire suppressing liquid a solution of water with, at least, one surfactant selected from the group comprising sulfonates, sulfonoles, sulforicinates, wetting agents on basis of alkylfenoles. All said additives are surfactants having ability to create foams. Besides the cooling action, water has ability to isolate the center of burning from access of oxygen of air. All these agents are interchangeable and can be used both separately and in combination with each other.

Using of water solution of, at least, one salt of metals of the first or the second groups of the periodic system of elements as a fire suppressing liquid would also be effective. Application of salts of said metals on the one hand reduces the freezing temperature of water, that is valuable in itself at application of this method of fire suppressing in winter conditions or in conditions of far north, on the other hand they add to the cooling agent additional endothermic effect caused by dehydration and decomposition of said salts.

It would be not less effective to use as a cooling agent of a fire suppressing powder. It is caused by number of advantages in its operational properties. The powder does not evaporate, does not freeze over, it is easy to transport and storage. In comparison with water and its solutions various flame inhibiting powders have ability of comprehensive influence the center of burning. Besides the utilization of heat due to endothermic effect of decomposition, the products of powders decomposition have specific fire suppressive properties. For example, in case of using as the fire suppressing powder of the powder of carbonates and/or base carbonates of metals the for the second groups of the periodic system of elements, the carbon dioxide formed in result of thermal decomposition provides own fire suppression effect consisting in that, it reduces concentration of oxygen in the center of burning due to its diluting; It is also possible to use for the same purpose phosphates of ammonium or metals of the first and the second groups of the periodic system of elements. These agents at the thermal decomposition forms on the surface of burning an isolating film of polyphosphates preventing access of oxygen of air to the burning surface.

Both chlorides and sulfates of metals of the first and the second groups of the periodic system of elements at the thermal decomposition form compounds, inhibiting specific forms of burning reactions, in particular, those reactions which accompany oxidation of hydrocarbons.

Our tests have shown, that the highest effect is achieved, when as the cooling agent it is used a fire suppressing environment comprising a fire suppressing powder atomized in the flame inhibiting aerosol. It is caused by that, dispersion of the fire suppressing powder in aerosol allows to distribute it more evenly on the surface of burning or on elements contacting with the center of burning. Besides, the flame inhibiting aerosol passivates the gaseous products of burning additionally reducing probability of their resumed self-ignition, that is a positive effect.

Similarly, it is possible to use as a cooling agent a fire suppressing environment comprising a fire suppressing liquid fine atomized in the flame inhibiting aerosol. It allows on the one hand to increase penetrating ability of the cooling agent into the center of burning, and on the other hand to increase heat removal from the center of burning due to more effective evaporation of the liquid caused by highly dispersed structure of the cooling agent. Thus it is necessary to emphasize, that the above mentioned powders and the above mentioned liquids are suitable for use as fire suppressing powders and fire suppressing liquids for dispersion in the flame inhibiting aerosol.

It would be expedient to obtain the flame inhibiting aerosol by burning of aerosol-forming composition containing combustible binder, comprising a cellulose nitrate plasticizated by hard volatile plasticizer, selected from the group of: triacetin, mix of nitroesters of diethylene glycol and triethylene glycol; an oxidizer on the basis of nitrates of metals of the first group of the periodic system; and a modifier of burning comprising technical carbon with highly-developed surface. Thus it could be obtained a flame inhibiting aerosol with firm particles, with size of order of one micrometer and less. To receive an aerosol with such firm and fine particles by mechanical or other way is practically impossible. Application of nitrocellulose gives a number of advantages, first of all, rather high mechanical stability of the aerosol forming charge, than, it creates an opportunity of continuous technological process of manufacturing of the aerosol forming charges of a various configuration, and the polymeric basis—nitrocellulose—has in comparison with other polymers ability of more complete gasification in the process of burning. The presence of the modifier of burning allows to avoid splattering of melted nitrates of metals of the first group of the periodic system in the process of burning of the aerosol forming charge. Besides the presence of the modifier of burning allows on the one hand to stabilize process of burning at low pressure, and on the other hand to control speed of burning in sufficiently wide range.

In process of burning of the aerosol forming composition it is liberated kinetic energy in form of the pressure of gases sufficient for transportation (supplying and introduction) of the fire suppressing powder or the fire suppressing liquid into the center of burning. In other words, there is no necessity to create additional, constantly working sources of pressure and accompanying equipment, this is an additional advantage of the present invention.

It is expediently before the introduction into the center of burning to cool the flow of the flame inhibiting aerosol by its contact with a cooling means for the flow of the flame inhibiting aerosol. The cooled aerosol is less dangerous from the point of view of thermal damage of the environment (i.e. people, materials, constructions etc.), for example, in case of false start of the fire suppression system. Besides, having less density in comparison with not cooled aerosol the cooled aerosol is capable to more evenly fill the protected volume without separation into layers on height, that facilitates faster interruption of chain reactions of the flame in the center of burning.

The above described method is embodied, substantially, by the fire extinguishing system presented below.

Said system comprises substantially: (a) a generator for introducing into the center of burning of the flame inhibiting aerosol concentration of which exceeds the concentration sufficient for interruption of the flame chain reaction, that results in liquidation of the flame with remaining smoldering of products of burning in the center of burning; (b) a means for introducing into the center of burning and/or to an element contacting to the center of burning of the cooling agent having endothermic properties and lowering the temperature in the center of burning up to the level lower than the temperature of resuming of the flame chain reactions in the center of burning; (c) at least one second means for introducing into the center of burning of additional portions of the cooling agent for maintenance in the center of burning the temperature level lower than the temperature of resuming of chain reactions of the flame in the center of burning up to the moment, when own maximal temperature of the center of burning will become lower than the temperature of resuming of reactions of burning in the products of burning, that results in liquidation of smoldering of the products of burning and in extinguishing the fire as a whole; (d) a first Initiating means installed in said generator for actuating the generator for introducing into the center of burning of the flame inhibiting aerosol; (e) a second initiating means installed in the first means for actuating said first means for introducing the cooling agent into the center of burning; (f) a third initiating means installed in said second means for actuating the second means for introducing additional portions of the cooling agent into the center of burning; (g) a means for programmed consecutive starting of the first initiating means, the second initiating means and the third initiating means; (h) a first control line connecting the output of the means for programmed consecutive starting to the input of the first initiating means and intended for transmitting starting command signals from the means for programmed consecutive starting to the first initiating means; (i) a second control line connecting the output of the means for programmed consecutive starting to the input of the second initiating means and intended for transmitting starting command signals from the means for programmed consecutive starting to the second initiating means delayed in time from the staring command signals coming to the first initiating means; (j) a third control line connecting the output of the means for programmed consecutive starting to the input of the third initiating means and intended for transmitting starting command signals from the means for programmed consecutive staring to the third initiating means delayed in time from the starting command signals coming to the second initiating means.

The above described fire extinguishing system allows to carry out in practice the tactics of extinguishing the fires embodied in the claimed method. First of all the fires of complex categories, when the fire is accompanied by flame burning in the gas phase and Blameless burning in the condensed phase in form of smoldering of firm combustible materials.

The above described fire extinguishing system can be in addition supplied with a means for detection in the center of burning of fire indications, said means for detection of fire indications is connected to the means for the programmed consecutive starting by a fourth control line intended for transmitting staring command signals from the output of the means for detection in the center of burning of fire indications to the input of the means for programmed consecutive starting. In this case the means for detection of fire indications in said center of burning can be performed as one of the devices selected from the group of: a fuse, a thermal sensor, a spectral sensor and a smoke sensor, depending on the analyzed indication of the fire.

It is expedient, that the means for programmed consecutive staring would comprise a control desk controlled by an operator or operating automatically.

It is possible an embodiment providing in the fire extinguishing system the first control line, the second control line and the third control line formed, correspondingly, by a first fuse, a second fuse and a third fuse of same type, connecting, correspondingly, the output of said means for programmed consecutive starting with, correspondingly, the input of the first initiating means, the input of the second initiating means and the input of the third initiating means, thus length of the first fuse is less than length of the second fuse and less than length of the third fuse, and length of the second fuse is less than length of the third fuse. Use of the fuses allows to design a completely independent system for detection of ignition in protected object, transmitting control signals of the initiating means of said system and staring of fire suppressing means comprised in it. It is especially favorable in the case, when protected objects are placed on significant distance from the means of communications and a power supply. The difference in length of fuses is caused by the necessity of providing of definite sequence in transmission of command starting signals, in order to provide predetermined tactics of fire extinguishing.

To increase reliability it is used a duplicating starting system comprising a fourth fuse connecting the first initiating means, the second initiating means and the third initiating means starting the means of fire suppression comprised in the present system.

The above mentioned objects can be achieved with help of a fire extinguishing generator comprising substantially: (a) a case; CD) a cavity formed in the case; (c) a first face wall of the case. (d) a second face wall of the case; (e) a lateral wall of the case connected by its first end face and its second end face with, correspondingly, the first face wall and the second face wall; (f) the central partition formed in the cavity of the case and fixed on the edges on the case lateral wall; (g) a first chamber formed from the side of the first face wall and delimited by the central partition, the first face wall and the lateral wall of the case; (h) a second chamber formed on the side of the second face wall and delimited by the central partition. The second face wall and the lateral wall of the case; (i) a charge of the flame inhibiting aerosol, installed in the first chamber at the first face wall and intended for producing of the flow of the flame inhibiting aerosol; 6) a cooling means the flow of the flame inhibiting aerosol fixed in the first chamber at the central partition and comprising a solid cooling block having a plurality of channels for passage the flow of the flame inhibiting aerosol through it, the solid cooling block is made from a material containing at least one agent, selected from the group of: carbonates, base carbonates, hydrooxides and oxalates of metals of the first, the second, the third, the eighth groups of the periodic system; (k) a first empty cavity formed in the first chamber between the charge of the flame inhibiting aerosol and the cooling means; () an initiating means for actuating the generator placed in the charge of the flame inhibiting aerosol and capable to receive starting command signals; (m) an additional partition installed in the second chamber and fixed by the edges on the lateral wall of the case; (n) the second empty cavity formed in the second chamber and delimited by the central partition, the additional partition and the lateral wall of the case; (o) a third cavity formed in the second chamber and delimited by the additional partition. The second face wall and the lateral wall of said case; (p) a charge of fire suppressing agent placed in the third cavity, said fire suppressing agent has endothermic properties and decreases the temperature being introduced into the center of burning or to the element contacting with the center of burning to the level lower than the temperature of resuming of flame chain reactions in said center of burning,; (q) a first set of channels formed in the central partition and intended for passing of the flow of the flame inhibiting aerosol from the first chamber into the second empty cavity; (r) a second set of channels formed in the additional partition and intended for passing of the flow of the flame inhibiting aerosol from the second empty cavity into the third cavity filled by the charge of the fire suppressing agent; (s) a third set of channels formed in the second face wall of the case and intended for passing the fire suppressing agent from third cavity filled by the charge of the fire suppressing of agent into the center of burning or to the element contacting with the center of burning.

Improvement of the generator—designed according to the present invention—consists in performing by the specified manner the cooling means of the flow of the flame inhibiting aerosol. At passage of the flow of the flame inhibiting aerosol—which temperature at this moment comes to 1000° C.–1200° C.—through the solid cooling block it occurs heat transfer from the flow of aerosol to material of the cooling block Thus it is necessary to emphasize, that the process of heat transfer is not accompanied by any chemical reaction of agents comprised in the structure of the flow of aerosol and agents which comprised in the structure of the solid cooling block material. In result of this it is possible to avoid deactivation of firm particles of the fire suppressing aerosol. Besides, it is possible to preserve concentration of the firm particles of the aerosol in the flow exhausted from the generator, that results in preservation of its fire suppressing activity. Said agents selected for manufacturing of the solid cooling block—in addition to the endothermic properties—have ability to form gaseous products of decomposition preventing concretion of the firm particles of the aerosol on the surface of channels formed in the cooling block, that prevents filtration of the aerosol and preserves its fire suppressing efficiency. Besides, the above-mentioned type of the fire extinguishing generators comprise all positive features peculiar to the generators in which it is used a cooled flow of the flame inhibiting aerosol; namely, ability of uniform, without separation into layers on height, filling of the fire protected volume, prevention of thermal decomposition of the fire suppressing agent, its sintering in the case, when fire suppressing powders are used as the fire suppressing agent, or evaporation, when there-are used fire-suppressing liquids, and safety in operation, wide area of their application and other positive features.

It is necessary to specially emphasize that the process of cooling of aerosol is accompanied by using of its heat to gradual and superficial decomposition of the solid cooling block, in result of which there is occurring educing of additional gaseous fire suppressing agents adding to the flow of aerosol further fire suppressing means. For example, at decomposition of the block made from carbonates or base carbonates of metals of the first, the second. The third and the eighth groups of the periodic system, it is- formed carbon dioxide, and if the block is made from oxalates of the same metals, the oxides of carbon including carbon dioxide are formed. These gases themselves are active fire suppressing agents.

Said gaseous products educed from the solid cooling block strengthen transporting function of the flow of the flame inhibiting aerosol.

In order to manufacture the solid cooling block in a predetermined exterior form and in order to form the internal channels of the block in a predetermined configuration, at least one polymeric binding from the class of plasticized derivatives of cellulose is added into the block material.

It is expediently to use a fire suppressing liquid as the fire suppressing agent, for example, water or water solution of at least one surfactant selected from the group, consisting from sulfonates, sulfonoles, sulforicinates, wetting agents based on alkilfenoles.

It is possible an embodiment, when a water solution of at least one salt of metals of the first or the second groups of the periodic system of elements is used as the fire suppressing liquid.

All these flame inhibiting liquids possess all the positive features of the flame inhibiting liquids described at considerations of the method of extinguishing a fire according to the present invention It is not less expediently to use as a fire suppressing agent the fire suppressing powder, for example, a powder of at least one agent selected from the group of carbonates and/or base carbonates of the metals of the first or the second groups of the periodic system of elements, phosphates of ammonia or metals of the first and the second groups of the periodic system of elements, chlorides and sulfates of metals of the first and the second groups of the periodic system of elements.

All these flame inhibiting powders possess also all the positive features of the flame inhibiting powders described at considerations of the method of extinguishing a fire according to the present invention It is possible an embodiment of manufacturing of the fire extinguishing generator, in which between the additional partition and the charge of the fire suppressing agent it is installed a first membrane penetrable for said flame inhibiting aerosol at its passage from the second empty cavity into said third cavity filled with the charge of the fire suppressing agent The installation of such membrane ensures preventing of entry of the fire suppressing agent into the second empty cavity which is necessary for exhausting the cooled flame inhibiting aerosol and creation of secondary superfluous pressure for displacement of the fire sup pressing agent from the generator according to the present invention It is also possible an embodiment of manufacturing of the generator, at which between the second face wall of the case and the charge of the fire suppressing agent it is installed a second membrane penetrable for said flame inhibiting aerosol at its passage from said third cavity filled with the charge of fire suppressing agent into-the center of burning or to the element connected to the center of burning. It is necessary for prevention of spilling in case of using of the fire suppressing powder, or for prevention of seeping, if it is used the fire suppressing liquid. In other words both the first and the second membranes are used for compact storage of the fire suppressing of agent in the generator.

It is reasonable to use in construction of such generator of a means for saturation of the fire suppressing agent by said flame inhibiting aerosol. For example, said means can be formed as a pipeline, first end of which is fixed on the additional partition, and its second end is fixed on the second face wall of the case, thus the internal cavity of the pipeline is connected with the second empty cavity by means of an aperture made in the additional partition, and with the third cavity filled with the charge of fire suppressing of agent, by means of a set of apertures made in the wall of the pipeline.

Saturation of the fire suppressing agent by the flame inhibiting aerosol creates a condition for more uniform displacement of the fire suppressing agent from the generator, i.e. for more uniform filling of the protected volume by the fire suppressing agent Even in the event when the powder was compacted during storage, said means loosens it at operation of the generator.

It is possible to use the above described fire extinguishing generator as the above-stated means for feeding of the cooling agent into the center of burning or to an element contacting with the center of burning. In other words, it is expedient to use this generator in the above described fire extinguishing system embodying the method of extinguishing a fire according to the present inventions Though it is necessary to emphasize, that it can be used as a means for fire suppression operating independently.

BEST METHOD OF CARRYING OUT THE INVENTION

Figure 1:
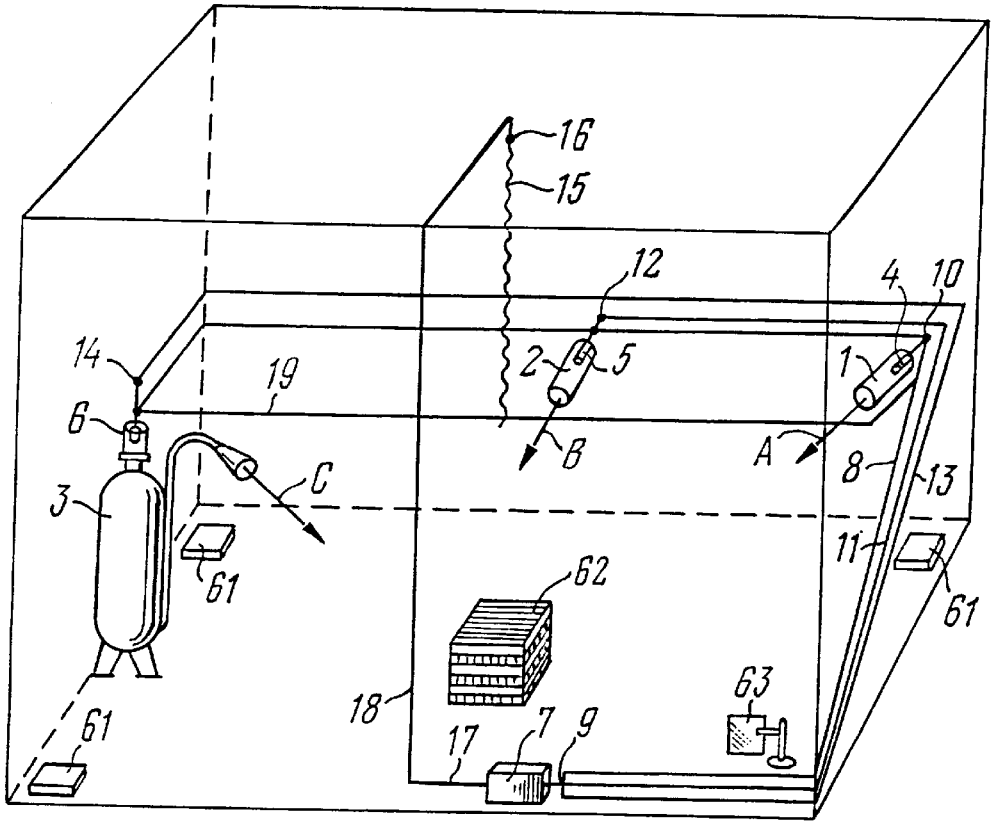
FIG. 1 represents a schematic view in the perspective of the fire extinguishing system embodying the method of extinguishing a fire according to the present invention.

FIG. 1 presents a schematic diagram of the fire extinguishing system carried out according to the present invention, realizing the claimed method of extinguishing a fire and containing, substantially, a first generator 1 for introducing into the center of burning the flame inhibiting aerosol interrupting flame chain reaction. Besides, said system contains a means 2 for introducing the cooling agent into the center of burning and/or to the element contacting with the center of burning. The system comprises also a second means 3 for introducing into the center of burning of additional portions of the cooling agent A first initiating means 4 is installed in the generator I for actuating the generator I for introducing into the center of burning the flame inhibiting aerosol. The first means 2 for introducing the cooling agent into the center of burning and/or to the element contacting with the center of burning, contains a second initiating means 5 for actuating said first means 2 for introducing the cooling agent into the center of burning. A third initiating means 6 is provided in the system for actuating the second means 3 for introducing into the center of burning of additional portions of cooling agent which is installed in said second means 3. The fire extinguishing system provides a means 7 for the programmed consecutive starting of the first initiating means 4, the second initiating means 5 and the third initiating means 6, it also contains a first control line 8 connecting the output 9 of the means for programmed consecutive starting to the input 10 of the first initiating means 4 and intended for transmission from the means 7 for programmed consecutive starting to the first initiating means 4 of staring command signals, a second control line 11 connecting the output 9 of the means 7 for programmed consecutive staring to the input 12 of the second initiating means 5 and intended for transmitting from means 7 for programmed consecutive staring to the second initiating means 5 of starting command signals delayed on time in comparison with the starting command signals coming to the first initiating means 4, and a third control line 13 connecting the output 9 of the means 7 for programmed consecutive starting with the input 14 of the third initiating means 6 and intended for transmitting from the means 7 for programed consecutive starting to the third initiating means 6 of starting command signals delayed on time in comparison with the starting command signals coming to the second initiating-means 5. The fire extinguishing system, in addition, is provided with a means 15 for detection of fire indications, thus the output 16 of said means 15 is connected to the input 17 of the means 7 for programmed consecutive staring by a fourth control line 18 intended for transmitting of the starting command signals from the output 16 means 15 to the input 17 of the means 7 for programmed consecutive starting. The means 15 for detection of fire indications in said fire extinguishing system can be carried out as one of devices selected from the group of: a fuse, a thermal sensor, a spectral sensor and a smoke sensor. In the specified embodiment of the system said-means 15 and control line 18 are carried out as a single fuse.

The means 7 for the programmed consecutive starting comprises a control desk operating automatically. In case of application of other types of means for detection of fire indications, there are also applied other types of control lines, and the means for the programmed consecutive starting can also work automatically or can be supervised by an operator. In the given embodiment of the fire extinguishing system the first control line 8, the second control line 11 and the third line control line 13 are formed, accordingly, by the first fuse, the second fuse and the third fuse of the same type connecting, accordingly, the output 9 of said means 7 for the programmed consecutive starting with, accordingly, the input 10 of the first initiating means 4, the input 12 of the second initiating means 5 and the input 14 of the third initiating means 6, thus the length of the first fuse is less than the length of the second fuse and less than the length of the third fuse, and length of the second fuse is less than length of the third fuse.

In order to increase reliability the given fire extinguishing system is provided with a duplicating starting system 19 carried out as a fourth fuse, connecting the first initiating means 4, the second initiating means S and the third initiating means 6, starting the fire extinguishing means and included into the present system.

Figure 2:
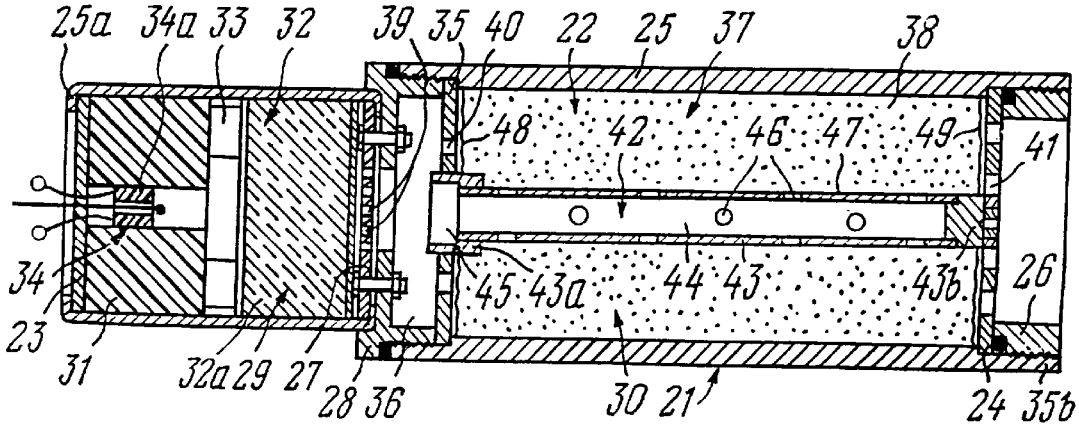
FIG. 2 represents an embodiment of the fire extinguishing generator with the fire suppressing powder used as the fire suppressing agent, carried out according to the present invention, in axial section.

FIG. 2 represents the fire extinguishing generator which is used as the means 2 for introducing of the cooling agent into the center of the fire or to the element contacting with said center of burning. This fire extinguishing generator contains, substantially, a case 21, having an internal cavity 22, formed in the case 21. The generator has a first face wall 23 of the case 21, a second face wall 24 of the case 21 and a lateral wall 25 of the case 21. The lateral wall 25 is connected by its first end face 25*a* and its second end face 25*b* with, accordingly, the first face wall 23 and the second face wall 24. Construction of the given generator provides a pressure ring 26 pressing the second face wall 24 to a recess executed in a lateral wall 25 of the case 21. Besides, the construction of the generator provides a central partition 27, executed in the cavity 22 of the case 21 and fixed on the edges on the lateral wall 25 of the case 21 by means of an intermediary element 28. Due to the central partition 27 it is formed a first chamber 29, delimited by the first face wall 23, the central partition 27 and the lateral wall 25 of the case 21, and a second chamber 30 formed at the side of the second face wall 24 and delimited by the central partition 27, the second face wall 24 and the lateral wall 25 of the case 21. In the first chamber 29 at the first face wall 23 of the case 21 it is installed a charge 31 of the flame inhibiting aerosol, intended for producing a flow A (FIG. 1) of the flame inhibiting aerosol. Besides, it is provided a means 32 for cooling the flow of the flame inhibiting aerosol, fixed in the first chamber 29 at the central partition 27. Said means 32 for cooling the flow of the flame inhibiting aerosol comprises a solid cooling block 32*a* having a set of channels (not shown on the drawings) for passage of the flow of the flame inhibiting aerosol through it. The solid cooling block 32*a* is made from a material comprising a composition of a base potassium carbonate n $Mg(O)_2 \cdot m\ MgCO_3$ and a polymeric binding, comprising a binding from the class of plasticized derivatives of cellulose, namely, in the given embodiment it is applied nitrocellulose, plasticized by glycerinthriacetate. In the first chamber 29, between the charge 31 of the flame inhibiting aerosol and the means 32 for cooling, it is formed an empty cavity 33. In the charge 31 of the flame inhibiting aerosol it is installed an initiating means 34 for actuating the generator adapted to receiving of stating command signals from the means 7 for programmed consecutive starting. Said initiating means 34 is shown on FIG. 1, which describes the fire extinguishing system, which is designated by position 5. In the given embodiment the initiating means 34 is carried out as an inflammable block 34*a* of cylindrical form made from an aerosol forming composition, similar to the composition of the charge 31 of the flame inhibiting aerosol. An active element of the initiating means 34 is the block 34*a*. In the second chamber 30 an additional partition 35 is installed, which is fixed by the edges on the lateral wall 25 of the case 21, thus said intermediary element 28 presses the additional partition 35 to the recess formed on the lateral wall 25 of the case 21. In the second chamber 30 it is formed a second empty cavity 36, delimited by the central partition 27, the additional partition 35 and the lateral wall 25 of the case 21. Besides in the second chamber 30 it is formed a third cavity 37, delimited by an additional partition 35, the second face wall by 24 and the lateral wall 25 of the case 21. In the third cavity 37 it is placed the charge 38 of the fire suppressing agent having endothermic properties and lowering temperature at its introducing into the center of burning or to the element contacting with the center of burning, up to the level lower than the temperature of resuming of chain reactions of the flame in said center of burning. In the given embodiment it is expedient to use a fire suppressing powder as the fire suppressing agent, namely diammonium phosphate. It is provided in the central partition 27 a first set of channels 39, intended for passing the flow of the flame inhibiting aerosol from the first chamber 29 in the second empty cavity 36. It is provided in the additional partition 35 a second set of channels 40, intended for passing the flow of the flame inhibiting aerosol from the second empty cavity 36 into the third cavity 37, filled by a charge 38 of the fire suppressing agent Besides, it is provided a third set of channels 41, executed in the second face wall 24 of the case 21 and intended for passing of the flow of the fire suppressing agent from the third cavity 37, filled by the charge 38 of the fire suppressing agent into the center of burning or to the element contacting with the center of bunting. The charge 31 of the flame inhibiting aerosol comprises a composition containing combustible binding of nitrocellulose plasticized by a hard volatile plasticizer, namely, by glycerintriacetate, an oxidizer on base of potassium nitrate and a burning modifier of technical carbon with highly developed surface. Construction of this generator provides a means 42 for saturation of the fire suppressing agent by a flame inhibiting aerosol. Said means is executed as a pipeline 43, the first end 43*a* of which is fixed on the additional partition 35, and its second end 43*b* is fixed on the second face wall 24 of the case 21. The internal cavity 44 of the pipeline 43 is connected with the second empty cavity 36 by means of an aperture 45, provided in the additional partition 35, and with the third cavity 37, filled by the fire suppressing agent, by means of a set of apertures 46, executed in the wall 47 of the pipelines 43. Between the additional partition 35 and the charge 38 of the fire suppressing agent it is installed the first membrane 48 penetrable for said flow of the flame inhibiting aerosol at its passage from the second empty cavity 36 into said third cavity 37. Besides, between the second face wall 24 of the case 21 and the charge 38 of the fire suppressing agent it is provided a second membrane, penetrable for said flow of the flame inhibiting aerosol at its passage from said third cavity 37 filled with a charge 38, into the center of burning or to an element connected to the center of burning.

Figure 3:
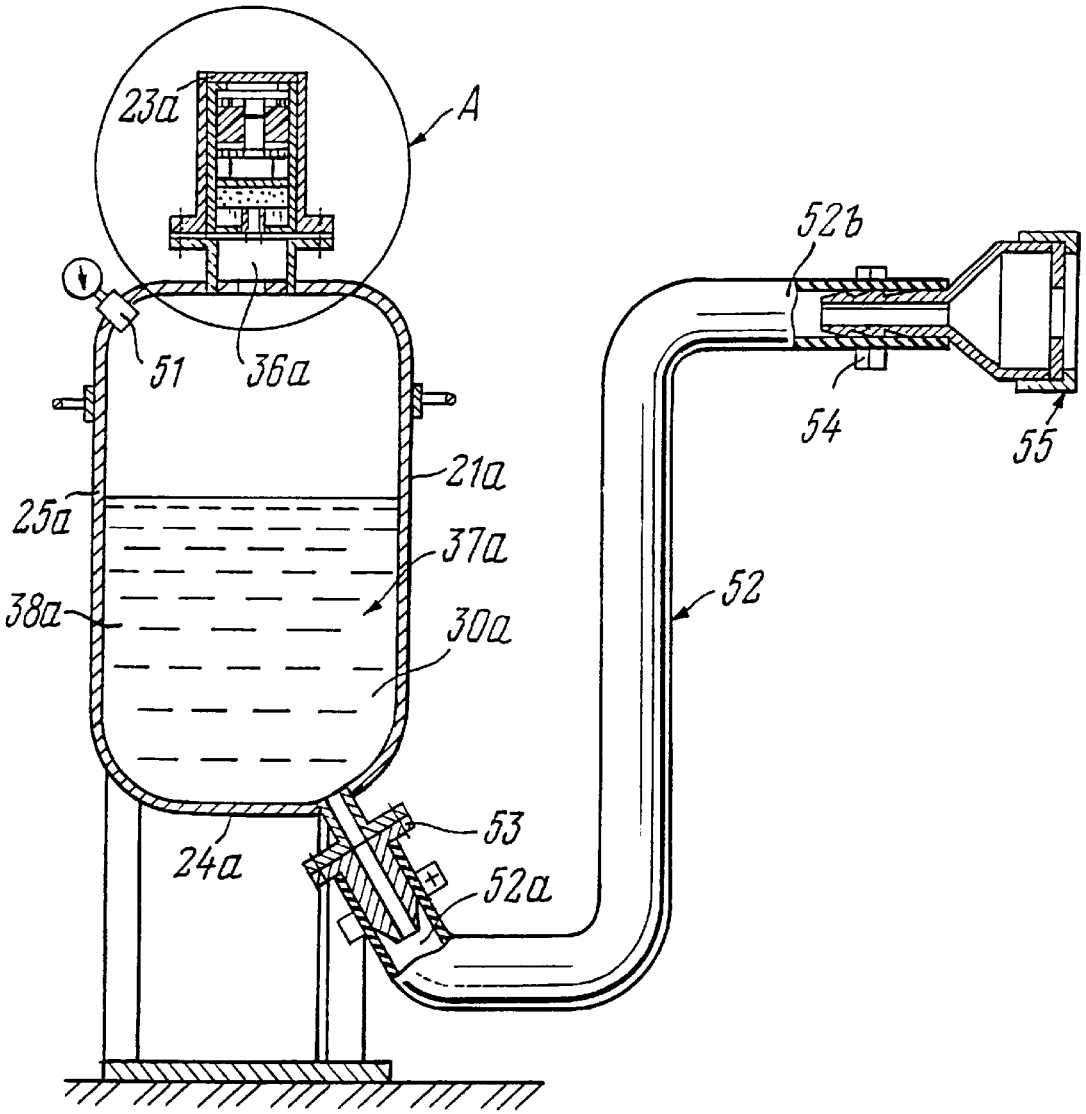
FIG. 3 represents an embodiment of performance of the fire extinguishing generator with the fire suppressing liquid used as the fire suppressing agent, carried out according to the present invention, in axial section.
Figure 4:
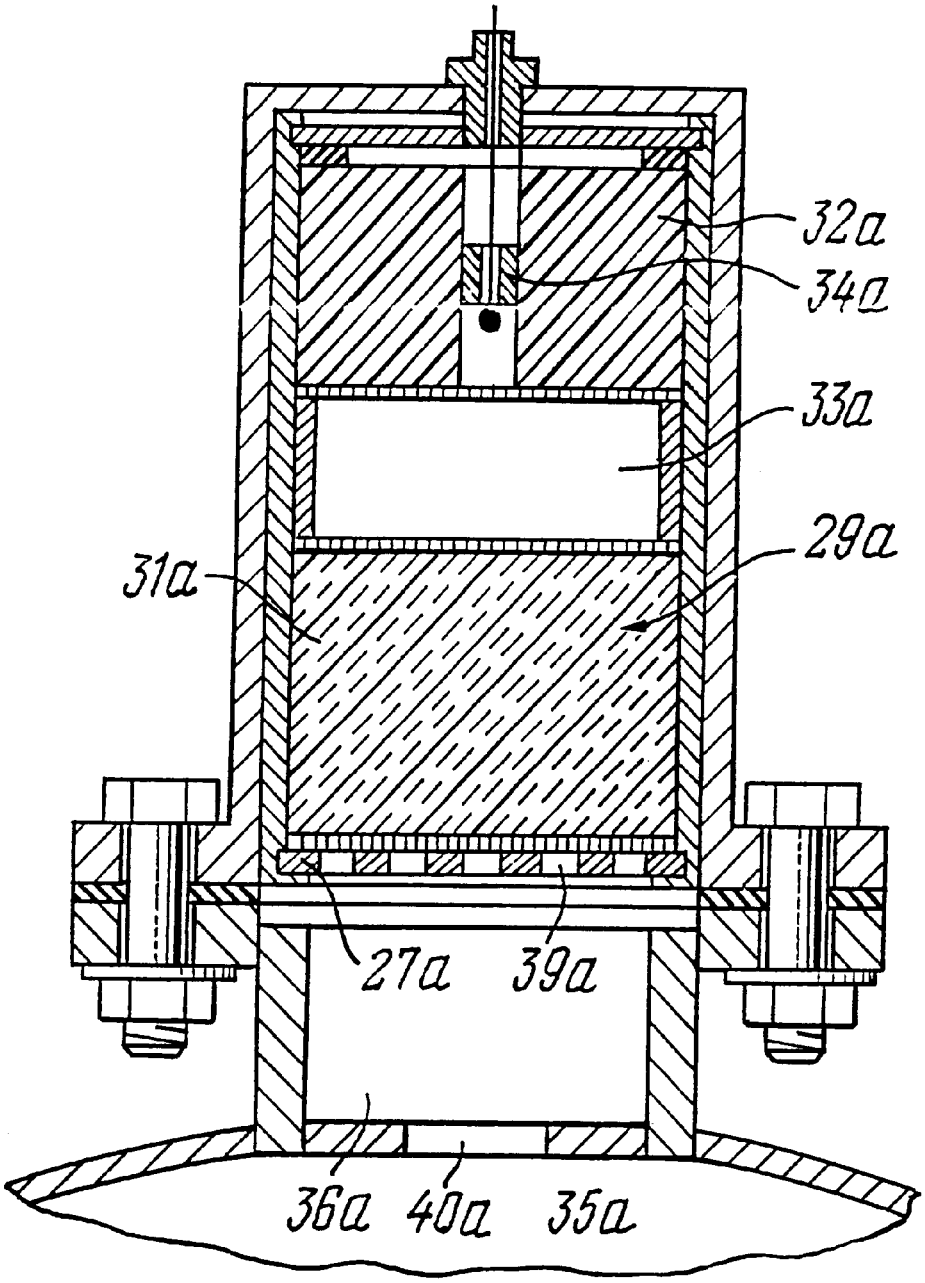
FIG. 4 represents the increased view of unit IV, shown on FIG. 3, in axial section.

Besides, in the considered fire extinguishing system shown on FIG. 1, it is provided a means 3 for introducing of additional portions of cooling agent executed as the fire extinguishing generator shown on FIG. 3 and FIG. 4, and in which a fire suppressing liquid is used as a cooling agent The construction of this generator, as a whole, is similar to construction of the generator represented on FIG. 2, and, in order to avoid repeating of the description, the positions of the basic constructive elements similar for the constructive purpose, having an additional index "a" are taken from FIG.

2 to FIG. 3 and FIG. 4. In other words, the numbers of positions of similar constructive elements on FIG. 2 and FIG. 3, FIG. 4 coincide. The main differences consist in that, for the charge 31*a* of the flame inhibiting aerosol it is used a block of aerosol forming composition containing nitrocellulose plasticized by a mix of nitroesters of diethylene glycol and triethylene glycol as a combustible binding, it is applied sodium nitrate as an oxidizer and technical carbon with highly developed surface as modifier of burning. Thus the solid cooling block 32*a* is executed from a material comprising a composition of sodium carbonate $Na_2CO_3$ and potassium oxalate $Ka_2C_2O_4$. Said composition in addition comprises a polymeric binding of nitrocellulose plasticized by glycerintriacetate. The charge 38*a* of the fire suppressing agent comprises a fire suppressing liquid, namely a water solution of sodium carbonate. The given construction of the fire extinguishing generator does not contain a means for saturation of the fire suppressing agent by the fire suppressing aerosol. However its design provides a manometer 51 for measurement of superfluous pressure in the cavity 37, filled by the fire suppressing liquid. Besides, the generator is supplied with a means 52 for the directed introducing of jet C (FIG. 1) of the fire suppressing liquid into the center of burning, comprising a flexible hose, one end 52*a* of which is connected by means of a flange connection 53 to the case 21 of the generator, and its second end 52*b* is connected by means of a flange connection 54 with a spraying header 55.

The fire extinguishing system shown on FIG. 1 and embodying the method of extinguishing a fire according to the present invention, operates in the following way. The system was activated at ignition of gasoline stored in open capacities 61 with volume of 2.5 liters, of a stack 62 of coniferous wood ledges, having section of 30 mm×30 mm and length of 300 mm each, stacked in 6 rows of 36 ledges. Besides, as one of the centers of burning it was used a plate 63 of polymethyl methacrylate (organic glass) with size of 250 mm×250 mm ×5 mm. In other words it was organized a fire with centers of classes A and B, it was simulated in other words a fire of complex category. The fire occurred in a room having size of 2.5 m×2,7 m×3 m. The centers of the fire were situated as follows: the stack 62 of ledges was placed at the center of the room, plate 63 of organic glass and capacities 61 with gasoline were placed on comers of the room. The generator 1 for introduction of the flame inhibiting aerosol was fixed on one of the walls of the room, at height 2 m and was so oriented that a flow A of aerosol exhausting from it made with the horizon a corner, approximately, 45°. Weight of the charge of aerosol forming composition before ignition was 1 kg. The means 2 for introduction into the center of burning of the cooling agent, and namely aerosol-powder fire extinguishing generator was fixed on the wall of the room on adjacent to the generator to 1 side. Weight of the charge 31 of aerosol forming composition made 200 g., and weight of the charge 38 of the fire suppressing powder made 1.5 kg. The means 3 for introducing into the center of burning of additional portions of the cooling agent, and namely the aerosol-liquid generator, was placed on the floor of the room, thus its spraying header 55 was oriented in the direction to the central zone of the room. Means 15 for detection of fire indications, the lines 8, 11, 13, 18 and 19, executed as fuses, were fixed on the walls and ceiling of the protected room, and the means 7 for the programmed consecutive starting of generators 1, 2 and 3 comprised a unit connecting the ends of the fuses 8, 11, 13 and 18, thus the means 7 was placed indoors. The means 15 for detection of fire indications was fixed on the ceiling of room in its central part in such a manner that the free—not fixed—end hanged down directly above the center of the fire in the central part of the room. At occurrence of the fire the flame from the center of the fire located at the center of the room ignited the fuse 15 (means for detection of fire indications) and the front of burning from the fuse 15 through the fuse 18 was transferred to the unit 7. Further in the unit 7 the fuses 8, 11 and 13 were ignited Separate fronts of burning on fuses 8, 11 and 13 were passed to, accordingly, initiating means 4, 5 and 6. Due to difference in length of cords 8, 11 and 13 it was achieved delay in start of the generator 2 and 3 in relation to the moment of start of the generator 1. The difference in the moments of initiating of generators 1, 2 and 3 made approximately 5 s. When the front of burning on the fuse 8 reached the initiating means 4 of the generators I its ignition occurred, which initiated ignition of the charge of the flame inhibiting aerosol. As a result of burning of this charge, the flow A of the flame inhibiting aerosol was formed which after exhausting from the generator 1 filled in the protected room. In result it was achieved liquidation of flame burning in the centers of burning, however it is necessary to emphasize, that the burning in the form of smoldering proceeded. Especially it was true for the center of burning formed by the stack of wooden ledges. In five seconds from the moment of initialization of the generator 1 the front of burning passing through the fuse 11 reached the initiating device 5 of the generator 2, that resulted in start of the generator 2. In more detail work of the generator 2 extinguishing the fire shown on FIG. 2, is described below. The front of burning on the fuse 11 came to the block 34*a* of the initiating means 34. In result it was ignited the block 34*a,* initiating ignition of the charge 31 of the flame inhibiting aerosol. As a result of burning of the charge 31 in the empty cavity 33 the flow of the flame inhibiting aerosol was formed which passed through the channels of the solid cooling block 32 and through the channels 39 formed in the central partition 27, came to the second empty cavity 36 and through the aperture 45 into the cavity 44 of the pipeline 43. At passage of the flow of the flame inhibiting aerosol through the solid cooling block 32 it occurred its intensive cooling. Accumulation of the cooled flame inhibiting aerosol resulted in formation of superfluous pressure in the second empty cavity 36 and in the cavity 44 of the pipeline 43. As result of it the membrane 48 was destroyed, and the aerosol mixed with the fire suppressing powder. Together with this, the flow of aerosol passed through the pluraity of apertures 46, made in the wall 47 of the pipeline 43, from the cavity 44 of the pipeline 43 into the cavity 37 with the fire suppressing powder. In the cavity 37 superfluous pressure was created which action resulted in destruction of the membrane 49 and displacement of fire suppressing aerosol-powder environment through the channels 41, formed in the second face wall 24 of the case 21, to the center 62 of burning formed by wooden ledges. As a result of it there was achieved decrease of the temperature in the center of burping up to the level lower than the temperature of resuming of flame chain reactions in the center of burning. It led to secured excluding of the repeated flame ignition, however decay of firm products of burning proceeded. In five seconds after the moment of initialization of the generator 2 front of burning of the fuse 13 reached the initiating device 6 of the generator 3, shown on FIG. 3. At this moment there started processes similar to processes at operation of the aerosol-powder generator 2. Exhaust of the flow of the cooled inhibiting aerosol from the second empty cavity 36*a* into the cavity 37*a* resulted in creation of superfluous pressure in it, that was measured by the manometer 51. It caused displacement of the fire suppressing liquid through the flexible hose 52 and to the spraying header 55 into the smoldering center of burning. It resulted in decreasing of the temperature in the center of burning up to the level lower than the temperature of resuming of reactions of burning, that at the end resulted in liquidation of the fire. The efficiency of the considered fire suppressing system is proved also by that fact, that the above described fire was extinguished in approximately 60 seconds from the moment of initialization of the means 15 for detection of fire indications. Examples 2, 3 and 4 of embodiments of the invention are given below. The examples describe in brief the basic parameters of the centers of burning simulating conditions of a fire, type of used means of detection of fire indications, constructive components of fire extinguishing system and there are given characteristics of efficiency of the claimed fire suppressive systems. For an expert having an average level of skills in the field of extinguishing fires the below-mentioned information and analysis of the above described first example of embodiment of the present invention are sufficient for creation of fire extinguishing systems carrying out the method according to the present invention.

EXAMPLE 2

The fire was simulated with help of the following combination of the centers of burning: at the center of a square room of volume 20 $m^3$ it was placed a stack from 36 coniferous wood ledges, in all corners of the room there were placed open capacities with 2.5 liters of gasoline in each.

Type of the used means for detection of fire indications—thermal sensor.

Each of control lines comprised a two-wire electrical cable, and the means for the programmed consecutive starting comprised a multichannel electrical time relay. The fire extinguishing system: the 1-st generator—a generator of the flame inhibiting aerosol, containing an aerosol forming charge comprising the composition containing potassium nitrate, nitrocellulose plasticized by a mix of nitrates of diethylene glycol and triethylene glycol, carbon with highly developed surface; the 2-nd generator—a generator of aerosol-powder type, in which the charge of the flame inhibiting aerosol comprised the same composition as the charge of the flame inhibiting aerosol of the 1-st generator of the present Example 2. The solid cooling block was made from aluminum hydroxide, and the charge of the fire suppressing powder from a composition containing, basically, sodium bicarbonate. The 3-rd generator—a, generator of aerosol-liquid type, in which the charge of the flame inhibiting aerosol comprised a composition containing potassium nitrate, nitrocellulose plasticized by glycerin triacetate, carbon with highly developed surface. The solid cooling block was executed of a material containing base magnesium carbonate and nitrocellulose plasticized by glycerin triacetate. The charge of the fire suppressing liquid comprised a water solution of sulfonoles. Extinguishing a fire was performed similarly to the described in the first example of embodiment of the present invention. The complete extinguishing of the centers, in other words extinguishing of the simulated fire, was carried out in 50 seconds.

EXAMPLE 3

The fire was simulated with help of the following combination of the centers of burning: at the center of a square room of volume 20 $m^3$ a stack from 36 coniferous wood ledges was placed, in two opposite comers of the room there were placed open capacities with gasoline of 2.5 liters each. In two other opposite comers there were placed plates from polymethyl methacrylate (organic glass) with sizes of 250 mm×250 mm×5 mm. Type of the used means of detection of fire indications - smoke sensor. Each of control lines comprised a two-wire electrical cable, and the means for the programmed consecutive starting comprised the multichannel electrical time relay. The fire extinguishing system: the 1-st generator—a generator of the flame inhibiting aerosol, containing an aerosol forming charge comprising the composition containing potassium nitrate, nitrocellulose plasticized by a mix of glycerin triacetate and carbon with highly developed surface; the 2-nd generator—a generator of aerosol-liquid type, in which the charge the flame inhibiting aerosol on the structure same as well as charge the flame inhibiting aerosol comprised the same composition as the charge of the flame inhibiting aerosol of the 1-st generator of the present Example 3. The solid cooling block was executed from a material comprising a composition, formed, basically, by base copper carbonate and nitrocellulose plasticized by glycerin triacetate. The charge of the fire suppressing liquid comprised a water solution of sulforicenates. The 3-rd generator—a generator of aerosol-powder type in which the charge of the flame inhibiting aerosol comprised a composition containing sodium nitrate, nitrocellulose plasticized by a mix of diethylene glycol nitrates and triethylene glycol, carbon with highly developed surface. The solid cooling block was made of a material containing iron oxalate and nitrocellulose plasticized by glycerin triacetate. The charge of the fire suppressing powder comprised a composition containing, basically, potassium sulfate and monoammonium phosphate. Extinguishing a fire was performed similarly to described in the first example of embodiment of the present invention. The complete extinguishing of the centers, in other words extinguishing of the simulated fire, was achieved in 38 seconds.

EXAMPLE 4

The fire was simulated with help of the following combination of the centers of burning: in the center of a square room of volume 20 $m^3$ it was placed a stack from 36 coniferous wood ledges, in one of corners of the room it was placed an open capacity with gasoline of volume 2.5 liters. In three other corners there were placed plates from polymethyl methacrylate (organic glass) with sizes of 250 mm×250 mm×5 mm. Type of the used means of detection of fire indications—spectral sensor. Each of control lines comprised a two-wire electrical cable, and the means for the programmed consecutive starting comprised the multichannel electrical time relay. The fire extinguishing system: the 1-st generator—a generator of the flame inhibiting aerosol, containing an aerosol forming charge comprising the composition containing potassium nitrate, nitrocellulose plasticized by a mix of nitrates of diethylene and triethylene glycol, carbon with highly developed surface, the generator on the output was supplied with a device representing, substantially, a Laval's nozzle. Weight of said charge—1.5 kg.; the 2-nd generator—a generator of aerosol-liquid type, in which the charge of the flame inhibiting aerosol comprised- a-composition containing, substantially, potassium nitrate, nitrocellulose plasticized by glycerin triacetate, carbon with highly developed surface. The solid cooling block was executed from a composition containing, substantially, base magnesium carbonate, nitrocellulose plasticized by glycerin triacetate. The charge of the fire suppressing powder comprised, substantially, a powder potassium chloride. Said generator on the output was supplied with a device representing, substantially, a mouth Weight the flame inhibiting charge of said generator—0.2 kg.

The 3-rd generator—a generator of aerosol-liquid type, in which the charge of the flame inhibiting aerosol was made from the composition similar to the described for the second generator of the present example. Weight of this charge was 0.2 kg too. The solid cooling block was executed of a material containing aluminum hydroxides. The charge of the fire suppressing liquid contained a water solution of alkyl phenols. Extinguishing a fire was performed similarly to the described in the first example of embodiment of the present invention. The complete extinguishing of the centers, in other words extinguishing of the simulated fire, was carried out in 25 seconds.

What is claimed is:

1. A method of extinguishing a fire providing, substantially, the following consecutive stages:

introducing into the center of burning the flow of flame inhibiting aerosol concentration of which exceeds the concentration sufficient for interruption of chain reactions of the flame, that results in liquidation of the flame with continuation of smoldering of products of burning in the center of burning;

(b) introducing into the center of burning and/or to an element contacting with the center of burning, a cooling agent having endothermic properties, that results in decreasing of the temperature in the center of burning to the level lower than the temperature of resuming of flame chain reactions in the center of burning;

(c) maintenance in the center of burning the temperature level lower than the temperature of resuming of flame chain reactions in the center of burning by means of introduction into the center of burning of additional portions of the cooling agent, introduction of additional portions of the cooling agent is being continued until the moment, when own maximal temperature of the center of burning will become lower than the temperature of resuming of burning reactions in products of burning, that results in liquidation of smoldering of products of burning and in extinguishing the fire as a whole.

2. A method according to claim 1, wherein introducing of the cooling agent into the center of burning is carried out after liquidation of the flame in the center of burning and before the concentration of the flame inhibiting aerosol will become equal to the level lower than the level of concentration of resuming of the flame chain reactions in the center of burning.

3. A method according to claim 1, wherein, if extinguishing a fire is carried out in open space, introducing of the flow of the cooled flame inhibiting aerosol into the center of burning is carried out with a speed exceeding the speed of convective gas flows escaping from the products of burning formed in the center of burning.

4. A method according to claim 1, wherein the contour of cross section of the flow of cooled flame inhibiting aerosol in the plane of the center of burning covers the contour of the center of burning in said plane.

5. A method according to claim 1, wherein a fire suppressing liquid is used as the cooling agent.

6. A method according to claim 5, wherein water is used as the fire suppressing liquid.

7. A method according to claim 5, wherein water solution of at least one surfactant selected from the group comprising sulfonates, sulfonoles, sulforicinates, wetting agents on basis of alkylfenoles is used as the fire suppressing liquid.

8. A method according to claim 5, wherein water solution of, at least, one salt of metals of the first or the second groups of the periodic system of elements is used as the fire suppressing liquid.

9. A method according to claim 1, wherein a fire suppressing powder is used as the cooling agent.

10. A method according to claim 9, wherein a powder of carbonates and/or base carbonates of metals the first or the second groups of the periodic system of elements is used as the fire suppressing powder.

11. A method according to claim 9, wherein a powder of phosphates of ammonium or metals of the first and the second groups of the periodic system of elements is used as the fire suppressing powder.

12. A method according to claim 9, wherein a powder of chlorides and sulfates of metals of the first and the second groups of the periodic system of elements is used as the fire suppressing powder.

13. A method according to claim 1, wherein a fire suppressing environment comprising a fire suppressing powder atomized in the flame inhibiting aerosol is used as a cooling agent.

14. A method according to claim 13, wherein a powder of carbonates and/or base carbonates of metals of the first or the second groups of the periodic system of elements is used as the flame inhibiting powder atomized in the flame inhibiting aerosol.

15. A method according to claim 13, wherein a powder of phosphates of ammonium or metals of the first and the second groups of the periodic system of elements is used as the flame suppressing powder atomized in the flame inhibiting aerosol.

16. A method according to claim 13, wherein a powder of chlorides or sulfates of metals of the first and the second groups of the periodic system of elements is used as the flame suppressing powder atomized in the flame inhibiting aerosol.

17. A method according to claim 1, wherein a fire suppressing environment comprising a fire suppressing liquid fine atomized in the flame inhibiting aerosol is used as the cooling agent.

18. A method according to claim 17, wherein water is used as fire-suppressing liquid fine atomized in the flame inhibiting aerosol.

19. A method according to claim 17, wherein a water solution with, at least, one surfactant selected from the group group comprising sulfonates, sulfonoles, sulforicinates, wetting agents on basis of alkylfenoles is used as the fire suppressing liquid fine atomized in the flame inhibiting aerosol.

20. A method according to claim 17, wherein a water solution of at least, one of the salts of metals of the first or the second groups of the periodic system of elements is used as the fire suppressing liquid fine atomized in the flame inhibiting aerosol.

21. A method according to claim 1 wherein the flame inhibiting aerosol is obtained by burning of an aerosol forming composition containing combustible binding comprising nitrocellulose plasticized by a hard volatile plasticizer selected from the group of: glycerin triacetate, mix of nitroesters of diethylene glycol and triethylene glycol; oxidizer on the base of nitrates of metals of the first group of the periodic system; and modifier of burning comprising technical carbon with highly developed surface.

22. A method according to claim 1, wherein a flow of the flame inhibiting aerosol before its introducing into the center of burning is cooled by contacting it with a cooling means of the flow of the flame inhibiting aerosol.

23. A fire extinguishing system containing, substantially:

a generator for introducing into the center of burning of the flame inhibiting aerosol concentration of which exceeds the concentration sufficient for interruption of the flame chain reaction, that results in liquidation of the flame with remaining smoldering of products of burning in the center of burning;

a first means for introducing into the center of burning and/or to an element contacting with the center of burning of the cooling agent having endothermic properties and lowering the temperature in the center of burning up to the level lower than the temperature of resuming of the flame chain reactions in the center of burning;

at least one second means for introducing into the center of burning of additional portions of the cooling agent for maintenance in the center of burning the temperature level lower than the temperature of resuming of chain reactions of the flame in the center of burning up to the moment, when own maximal temperature of the center of burning will become lower than the temperature of resuming of reactions of burning in the products of burning, that results in liquidation of smoldering of the products of burning and in extinguishing the fire as a whole;

a first initiating means for actuating the generator for introducing into the center of burning of the flame inhibiting aerosol installed in said generator;

a second initiating means for actuating said first means for introducing the cooling agent into the center of burning installed in the first means;

a third initiating means for actuating the second means for introducing additional portions of the cooling agent into the center of burning installed in said second means;

a means for programmed consecutive starting of the first initiating means, the second initiating means and the third initiating means;

a first control line connecting the output of the means for programmed consecutive starting to the input of the first initiating means and intended for sitting starting command signals from the means for programmed consecutive starting to the first initiating means;

a second control line connecting the output of the means for programmed consecutive starting to the input of the second initiating means and intended for transmitting starting command signals from the means for programmed consecutive starting to the second initiating means delayed in time from the staring command signals coming to the first initiating means;

a third control line connecting the output of the means for programmed consecutive starting to the input of the third initiating means and intended for transmitting starting command signals from the means for programmed consecutive starting to the third initiating means delayed in time from the starting command signals coming to the second initiating means.

24. A system according to claim 23, which in addition is supplied with a means for detection in the center of burning of fire indications, said means for detection of fire indications is connected to the means for the programmed consecutive staring by the fourth control line intended for transmitting of staring command signals from the output of the means for detection in the center of burning of fire indications to the input of the means for programmed consecutive starting.

25. A system according to claim 24, wherein the means for detection of fire indications in said center of burning can be carried out as one of device selected from the group of: fuse, thermal sensor, spectral sensor and smoke sensor, depending on analyzed indication of the fire.

26. A system according to claim 23, wherein the means for the programmed consecutive starting comprises a control desk controlled by an operator or working automatically.

27. A system according to claim 23, wherein the it control line, the second control line and the third control line formed correspondingly by a first fuse, a second fuse and a third fuse of same type connecting, correspondingly, the output of said means for programmed consecutive starting with, correspondingly, the input of the first initiating means, the input of the second initiating means and the input of the third initiating means, thus length of the first fuse is less than length of the second fuse and less than length of the third fuse, and length of the second fuse is less than length of the third fuse.

28. A system according to claim 27, wherein it is provided a duplicating starting system comprising a fourth fuse connecting the first initiating means, the second initiating means and the third initiating means starting the means of fire suppression comprised in the present system.

29. A fire extinguishing generator containing, substantially:

(a) a case;

(b) a cavity formed in the case;

(c) a first face wall of the case;

(d) a second face wall of the case;.

(e) a lateral wall of the case connected by its first end face and its second end face with, correspondingly, the first face wall and the second face wall;

(f) a central partition formed in the cavity of the case and fixed by it's edges on the case lateral wall;

(g) a first chamber formed from the side of the first face wall and delimited by the central partition, the first face wall and the lateral wall of the case;

(h) a second chamber formed on the side of the second face wall and delimited by the central partition, the second face wall and the lateral wall of the case;

(i) a charge of the flame inhibiting aerosol, installed in the first chamber at the first face wall and intended for producing of the flow of the flame inhibiting aerosol;

(j) a cooling means for the flow of the flame inhibiting aerosol fixed in the first chamber at the central partition and comprising a solid cooling block having a plurality of channels for passage the flow of the flame inhibiting aerosol through it, the solid cooling block is made from a material containing at least one agent, selected from the group of: carbonates, base carbonates, hydrooxides and oxalates of metals of the first, the second, the third, the eighth groups of the periodic system;

(k) a first empty cavity formed in the first chamber between the charge of the flame inhibiting aerosol and the cooling means;

(l) an initiating means for actuating the generator placed in the charge of the flame inhibiting aerosol and capable to receive starting command signals;

(m) an additional partition installed in the second chamber and fixed by it's edges on the lateral wall of the case;

(n) a second empty cavity formed in the second chamber and delimited by the central partition, the additional partition and the lateral wall of the case;

(o) a third cavity formed in the second chamber and delimited by the additional partition, the second face wall and the lateral wall of said case;

(p) a charge of cooling agent placed in the third cavity, said cooling agent has endothermic properties and decreases the temperature being introduced into the center of burning or to the element contacting with the center of burning to the level lower than the temperature of resuming of flame chain reactions in said center of burning;

(q) a first set of channels formed in the central partition and intended for passing of the flow of the flame inhibiting aerosol from the first chamber into the second empty cavity;

(r) a second set of channels formed in the additional partition and intended for passing of the flow of the flame inhibiting aerosol from the second empty cavity into the third cavity filled by the charge of the cooling agent;

(s) a third set of channels formed in the second face wall of the case and intended for passing the cooling agent from third cavity filled by the charge of the cooling agent into the center of burning or to the element contacting with the center of burning.

30. A generator according to claim 29, wherein the firm cooling the block in addition contains, at least one, polymeric binding from the class of plasticized derivatives of cellulose.

31. A generator according to claim 29, wherein the fire suppressing liquid is used as the cooling agent.

32. A generator according to claim 31, wherein the fire suppressing liquid comprises water.

33. A generator according to claim 31, wherein fire suppressing liquid comprises solution of water with, at least, one surfactant selected from the group consisting of sulfonates, sulfonoles, sulforicinates, wetting agents on basis of alkylfenoles.

34. A generator according to claim 31, wherein fire suppressing liquid comprises a water solution, of at least one salts of metals the first or the second groups of the periodic system of elements.

35. A generator according to claim 29, the wherein fire suppressing a powder is used as the cooling agent.

36. A generator according to claim 35, wherein the fire suppressing powder contains at least one agent selected from the group, formed by carbonates and/or base carbonates of metals of the first or the second groups of the periodic system of elements, ammonium phosphates or metals of the first and the second groups of the periodic system of elements, chlorides and sulfates of metals of the first and the second of groups of the periodic system of elements.

37. A generator according to claim 29, wherein between the additional partition and the charge of cooling agent it is installed a first membrane penetrable for said flame inhibiting aerosol at its passage from the second empty cavity into said third cavity filled with the charge of cooling agent.

38. A generator according to claim 29, wherein between the second face wall of the case and the charge of the cooling agent it is installed a second membrane penetrable for said flame inhibiting aerosol at its passage from said third cavity filled with the charge of cooling agent into the center of burning or to the element connected to the center of burning.

39. A generator according to claim 29, wherein it is provided a means for saturation of the cooling agent by said flame inhibiting aerosol.

40. A generator according to claim 39, wherein the means for saturation of the fire suppressing agent by said flame inhibiting aerosol is formed as a pipeline, first end of which is fixed on the additional partition, and its second end is fixed on the second face wall of the case, thus the internal cavity of the pipeline is connected with the second empty cavity by means of an aperture made in the additional partition, and with the third cavity filled with the charge of the cooling agent, by means of a set of apertures made in the wall of the pipeline.

* * * * *